United States Patent [19]

Bar

[11] 4,398,400

[45] Aug. 16, 1983

[54] TERMINAL BOARD AND RELAYS CASING ASSEMBLY IN MOTOR COMPRESSORS FOR REFRIGERATORS

[75] Inventor: Alfredo Bar, Pavia, Italy

[73] Assignee: Necchi Societa per Azioni, Pavia, Italy

[21] Appl. No.: 316,356

[22] Filed: Oct. 29, 1981

[30] Foreign Application Priority Data

Nov. 3, 1980 [IT] Italy ..... 42920 A/80

[51] Int. Cl.[3] ..... H02K 11/00; F25B 39/04

[52] U.S. Cl. ..... 62/508; 220/3.8; 310/71

[58] Field of Search ..... 62/508, 295; 310/89, 310/71; 220/3.8, 345; 174/67

[56] References Cited

U.S. PATENT DOCUMENTS

| | | | |
|---|---|---|---|
| 2,160,436 | 5/1939 | Jones | 220/345 X |
| 2,201,507 | 5/1940 | Stilwell | 220/3.8 X |
| 2,590,559 | 3/1952 | Miller | 310/71 |
| 2,986,299 | 5/1961 | Caparone et al. | 220/3.8 |
| 4,236,092 | 11/1980 | Di Flora | 62/508 X |

*Primary Examiner*—William E. Wayner

*Attorney, Agent, or Firm*—Stevens, Davis, Miller & Mosher

[57] ABSTRACT

Terminal board and relays casing assembly externally fixed in a suitable position on the sealed motor compressor housing placed in a suitable compartment defined in the lowest rear portion of the refrigerator. A side wall of the box in front of an observer who places himself behind the refrigerator, acts as a mounting for the terminal board, the electrical mains supply feeder cable being connected thereon. A cover slides on a suitable guide shaped to contain in the box the terminal board, the thermal protector and starting relays.

1 Claim, 3 Drawing Figures

TERMINAL BOARD AND RELAYS CASING ASSEMBLY IN MOTOR COMPRESSORS FOR REFRIGERATORS

DISCLOSURE OF THE INVENTION

The present invention relates to a terminal board and relays casing assembly in motor compressors for refrigerators and more particularly, to the shape and arrangement of the assembly.

In refrigerators the motor compressor unit is usually placed in a compartment defined in the lowest rear portion thereof. Pipes connecting the motor compressor to the evaporator and to the condenser run on the front portion of the motor compressor housing. Therefore the relays casing and the terminal board are necessarily placed sideways onto the housing. Every time that a new feeder cable to the terminal is to be connected or either the starter or thermal protector relay is to be replaced, or both, the box must be removed and reassembled again after executing the connection and/or the replacement of the relay.

In order to eliminate this inconvenience, a former embodiment slanted the ends of the terminal plates in such a way as to provide a certain accessibility by the operator who must fasten thereon the leads of the feeder cable making thus possible the replacement of the cable without disassembling the box. This embodiment still retained some disadvantages. It is therefore an object of the present invention to provide a box of improved shape containing the relays casing and the terminal board which makes it even easier to connect the electrical leads from the feeding line and replace the relays. This new shape of the box containing the relays casing and the terminal board is characterized in that it is formed by four side walls, is closed by the housing acting as its base and has a removable cover. On the side wall of the box in front of an observer placed behind the refrigerator a terminal board is provided for the connection of the motor compressor feeder cable.

Figure 1:
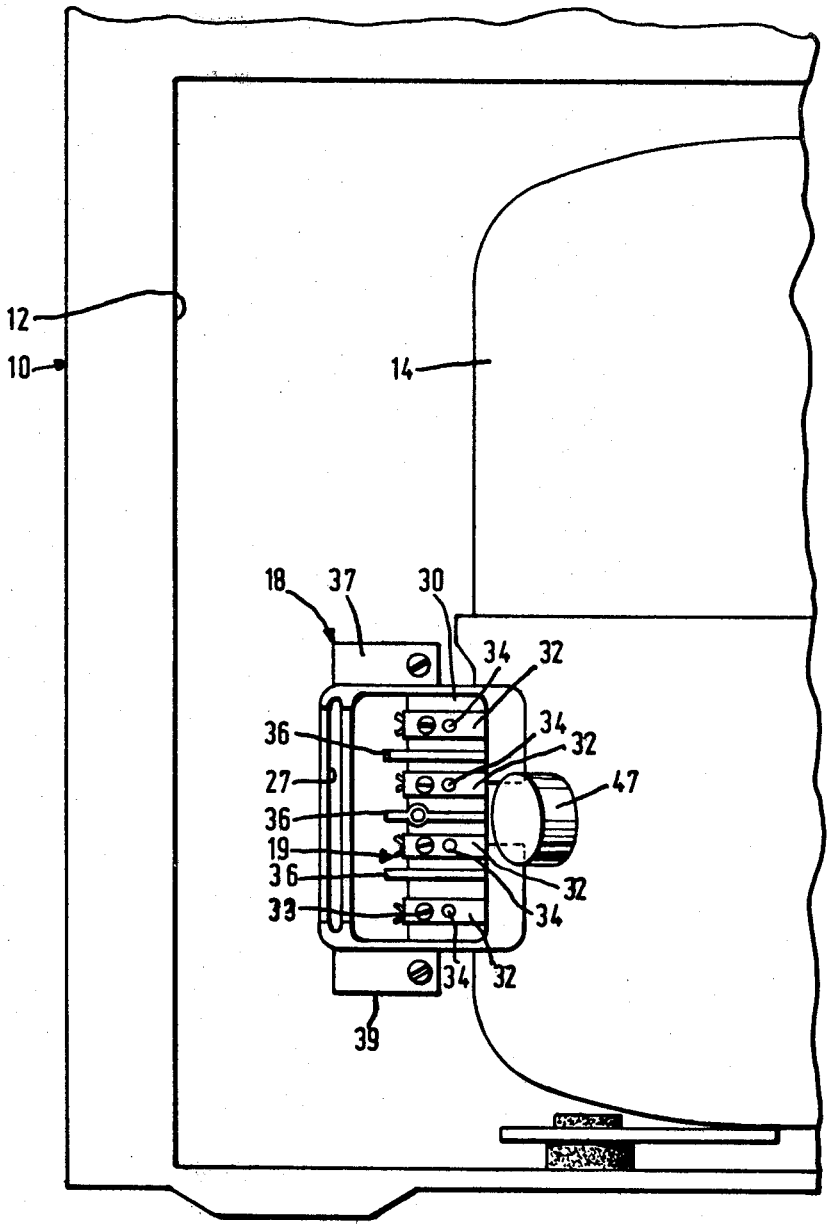
Figure 2:
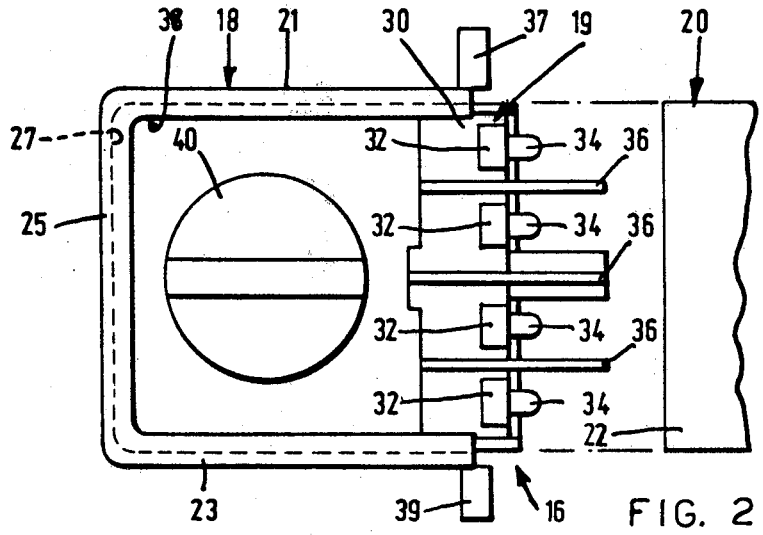
Figure 3:
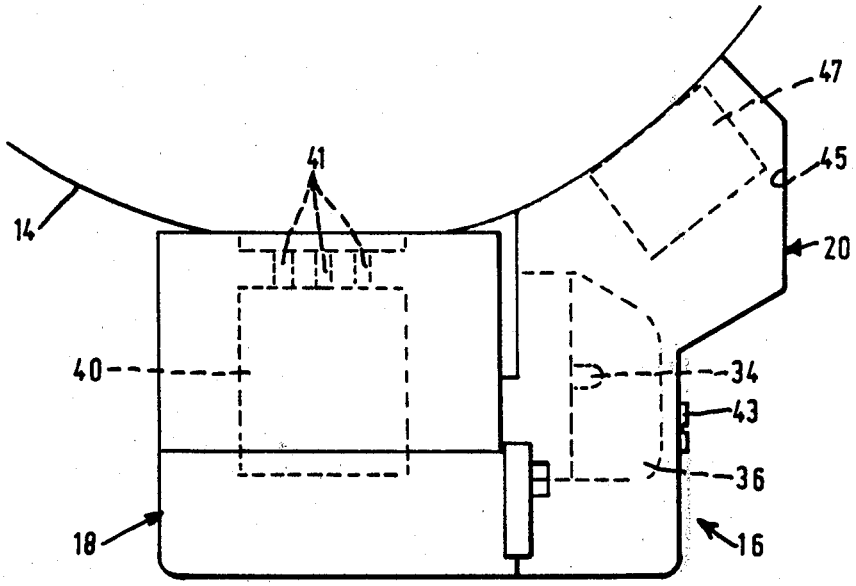

Further advantages and characteristics will be apparent from the following description of a preferred embodiment and from the enclosed drawings in which:

FIG. 1 shows a global view of the motor compressor and the relays casing-terminal board assembly, FIG. 2 shows a partial view of the relays casing-terminal board assembly, and FIG. 3 shows a global view from above of the assembly relays casing-terminal board of the invention.

With reference to FIG. 1 numeral 10 indicates the rear portion of a refrigerator in the lowest portion thereof. A compartment 12 is defined for the motor compressor contained in housing 14. Placed sideways on the lowest portion of housing 14 is an assembly 16 formed by the box 18 and the terminal board 19 usually of plastic material. Box 18 is formed by four side walls (FIGS. 2 and 3) 21, 23, 25 and 30 and is frontally closed by a plate portion 22 of a cover 20 having a complex structure whose function will be better disclosed hereinafter. Box 18 is open in correspondence with the opposite front surface which is in contact with the outer surface of housing 14 whereon the box is fixed conventionally. Box 18 contains the thermal protector relay 40 directly fixed through pins 41 onto housing 14. The starting relay 47 preferably formed by a PTCR (positive coefficient temperature resistor) is also directly fixed onto the motor compressor housing 14 close to the thermal protector 40. Cover 20 is formed by the plate portion 22 which acts as front cover of box 18, by a recess containing starting relay PTC 47 and the vertical wall 30 of the box 18.

A groove 27 is made in walls 21, 23, 25 of box 18 (FIG. 2) to act as a guide to portion 22 of cover 20. Connecting links 32 are placed onto wall 30 of box 18, on the face visible to an operator who is disposed behind the refrigerator 10 (FIG. 1). The terminals of feed conductors are fastened to connecting links 32 by means of screws 33. The connecting links 32 are provided also for coupling with FASTON terminals, not shown in the drawings, electrically connecting the terminal board to the motor compressor feed conductors. The connecting links 32 are kept in position by means of pins 34 made out onto wall 30 separated from one another by means of tongues 36 also made out onto wall 30. Blocks 37 and 39 are provided at the free end of walls 21 and 23 of box 18 acting as clamps for the feed conductors (FIG. 2).

Cover 20 with its plate portion 22 and recess portion 45 is placed in its operative position by sliding portion 22 along guides 27 of walls 21 and 23 of box 18 until the end portion of 22 sets itself inside guide 27 of wall 25. After this sliding, recess portion 45 is arranged, as shown in FIG. 3, thus covering terminal board 19 with the relevant connecting links 32 and the starting relay 47.

Space 38, containing thermal protector relay 40, is covered by plate portion 22.

Cover 20 is then fastened to box 18 by means of screw 43 thus making a unitary body.

Owing to the easy removal of the cover according to the object of the invention, terminal board 19 and the starting relay 47 and thermal protector relay 40 are quickly accessible by an operator for tightening and loosening screws 33 in case of replacement of the feeder cable and of the two relays 47 and 40. Starting relay 47 could be placed just as is the thermal protector 40, inside the four walls 21, 23, 25 and 30.

What is claimed is:

1. Terminal board and relays casing box and removable cover for sealed motor compressors forming an assembly positionable sideways on the outer surface of the motor compressor housing, said box defining four side walls, a base and an outer opening, said base being closed by the housing and said outer opening being closed by said removable cover, three of said four sides of said box defining guides into which slide sides of said cover, the fourth of said sides defining pins extending horizontally from said side and spaced vertically from each other and tongues extending horizontally from said side and positioned between said pins to which pins are positioned connecting links, said cover defining a recess portion to enclose the terminal board directly arranged on the outer surface of the said motor compressor housing.

* * * * *